US005150501A

United States Patent [19]

Pasternak

[11] Patent Number: 5,150,501

[45] Date of Patent: Sep. 29, 1992

[54] HINGE CONNECTING POST FOR FOLDING CLOSURES

[75] Inventor: Jeffrey Pasternak, Pierre Fonds, Canada

[73] Assignee: Dynaflair Corporation Canada Inc., Point Claire, Canada

[21] Appl. No.: 448,967

[22] Filed: Dec. 12, 1989

[51] Int. Cl.[5] ..... E05D 7/12; E05D 15/26

[52] U.S. Cl. ..... 16/272; 16/872; 160/199

[58] Field of Search ..... 16/260, 87 R, 87.2, 16/390; 160/199 X, 196.1, 213, 206

[56] References Cited

U.S. PATENT DOCUMENTS

| | | | |
|---|---|---|---|
| 2,572,153 | 10/1951 | Horn | 160/206 |
| 3,457,677 | 7/1969 | Ziegler | 16/87.2 |
| 4,084,289 | 4/1978 | Naimo | 16/87 R |
| 4,922,987 | 5/1990 | Marontate et al. | 160/199 |

*Primary Examiner*—Lowell A. Larson
*Assistant Examiner*—Michael J. McKeon
*Attorney, Agent, or Firm*—Oblon, Spivak, McClelland, Maier & Neustadt

[57] ABSTRACT

A folding closure displaceably supportable in an opening to secure the opening. The closure is comprised of a plurality of elongated vertical panels interconnected along their vertical edges by a hinge assembly to permit the panels to fold in an accordion fashion for storage and to extend in an undulating stretched manner to obstruct the opening. The hinge assembly has a plurality of hinge attaching members to pivotally secure a pair of opposed panel connecting posts thereto. Each of the connecting posts is detachably securable to the hinge attaching members. The connecting posts further have a connecting slot for securing panel elements thereto. The improvement resides in that the connecting slot has an extension protective flange at least on an outer side portion of the connecting post to overlap and conceal an attachment member of a connector strip removably secured in the connecting slot. The improvement also comprises the detachable securement being provided by a member which is integrally formed and disposed rearwardly of the connecting slot and has a connecting element extending from a rear wall of the connecting slot to provide a narrow width hinge assembly when in the folded stored accordion fashion.

9 Claims, 2 Drawing Sheets

HINGE CONNECTING POST FOR FOLDING CLOSURES

BACKGROUND OF INVENTION (a) Field of the Invention

The present invention relates to an improved hinge connecting post for folding closures and which protects the panel connector strips and wherein the connecting posts have detachable securement means which are disposed rearwardly of the connecting slot to provide a narrow width hinge assembly when in the folded stored position so that the folded closure takes less space when folded and requires less material to secure an opening.

(b) Description of Prior Art

With prior art hinge connecting posts for folding closures, the connector strip which connects the transparent panels to the connecting post is not protected and the rib of its T-shaped connector can be slit from the exterior of the closure as a portion thereof is visible intermediate the connecting post and the panels. Because the connector strip is made of plastics material, the blade of a knife can be inserted in the joint between the connecting post and the rear wall of the connector strip whereby to cut the securement rib and remove the transparent panel whereby to provide access to the inside of the folding closure.

Also, with known hinge assemblies of the type, described, when the folding closure is in a collapsed stored position with the panels having been folded in an accordion fashion, this folded closure tends to occupy a substantial amount of space in the opening and this is due primarily to the fact that the folded panels cannot be collapsed close to one another due to the construction of the hinge assembly. Also, due to the construction of the hinge assembly, when the closure is in its extended position, it follows a undulating pattern with adjacent panels extending in angular planes from one another. Because of this, it is necessary to have more panels than would otherwise be necessary should the panels be positioned in a common plane across the opening.

SUMMARY OF INVENTION

It is a feature of the present invention to substantially overcome all of the above-mentioned disadvantages of the prior art.

It is another feature of the present invention to provide an improved connecting post for use in a hinge assembly of a folding closure and wherein the connecting slot of the connecting post is provided with at least one protective flange to conceal the attachment member of a connector strip secured to the connecting post.

Another feature of the present invention is to provide a hinge connecting post of a hinge assembly for use in a folding closure and wherein the connecting post has a detachable securement means which is disposed rearwardly of the connecting slot which secures the connector strip whereby to displace the hinge point to the back side of the connecting slot.

It is another feature of the present invention to provide an improved connecting post structure for use in a hinge assembly of a folding closure which permits a material savings in the construction of the folding closure and which permits the closure to be collapsed to a storage position which occupies less space than known folding closures of the prior art, and which when extended, the panels are positioned closer to a common plane.

According to the above features, from a broad aspect, the present invention provides a folding closure displaceably supportable in an opening to secure the opening. The closure comprises a plurality of elongated vertical panels interconnected along their vertical edges by a hinge assembly to permit the panels to fold in an accordion fashion for storage, and to extend in an undulating stretched manner to obstruct the opening. The hinge assembly is provided with hinge attaching members to pivotally secure respective pairs of opposed panel connecting posts thereto. Each connecting post has detachable securement means for connection to the hinge attaching members. The connecting post further has a connecting slot for securing panel elements thereto. The improvement comprises in that the connecting slot has an extension protective flange on at least an outer side portion of the connecting post to overlap and conceal an attachment member of a connector strip which is removably secured in the connecting slot.

According to a further broad aspect of the present invention, the improvement resides in that the detachable securement means is integrally formed and disposed rearwardly of the connecting slot and has a connecting element extending from a rear wall of the connecting slot to provide a narrow width hinge assembly when folded to a stored accordion position.

BRIEF DESCRIPTION OF DRAWINGS

A preferred embodiment will now be described with reference to the accompanying drawings in which.

DESCRIPTION OF PREFERRED EMBODIMENTS

Figure 1:
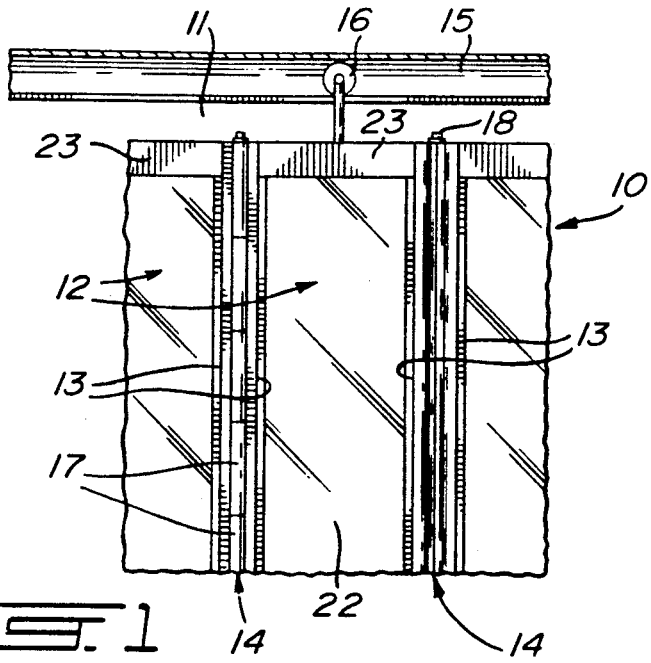
FIG. 1 is a fragmented side view illustrating a portion of a folding closure which is displaceably supported in an opening to secure the opening.
Figure 5:
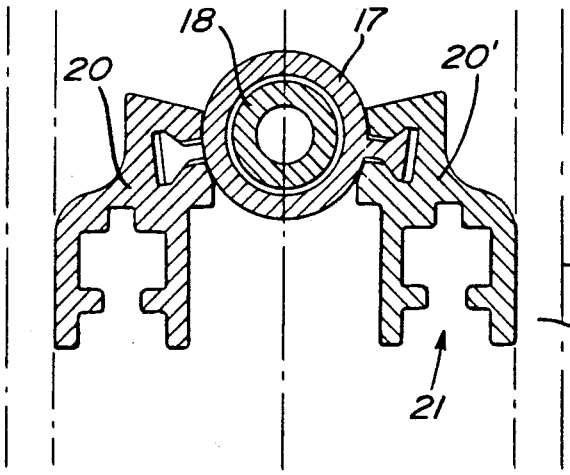
FIG. 5 is a section view showing the hinge assembly of the present invention in a stored position.

Referring now to the drawings, and more particularly to FIG. 1, there is shown generally at 10, a folding closure which is displaceably supported in an opening 11 to secure the opening. The folding closure 10 is comprised of a plurality of elongated vertical panels 12 which are interconnected along their vertical edges 13 by a hinge assembly 14 whereby to permit the panels to fold in an accordion fashion (as shown in FIG. 5) for storage of the panel against a side wall of the opening 11 and to extend in an undulating stretched manner (see FIG. 2) to obstruct the opening 11. These panels are usually supported by a guide rail 15 secured in the top wall of the opening and suspended by guide rollers 16, as is well known in the art.

Figure 2:
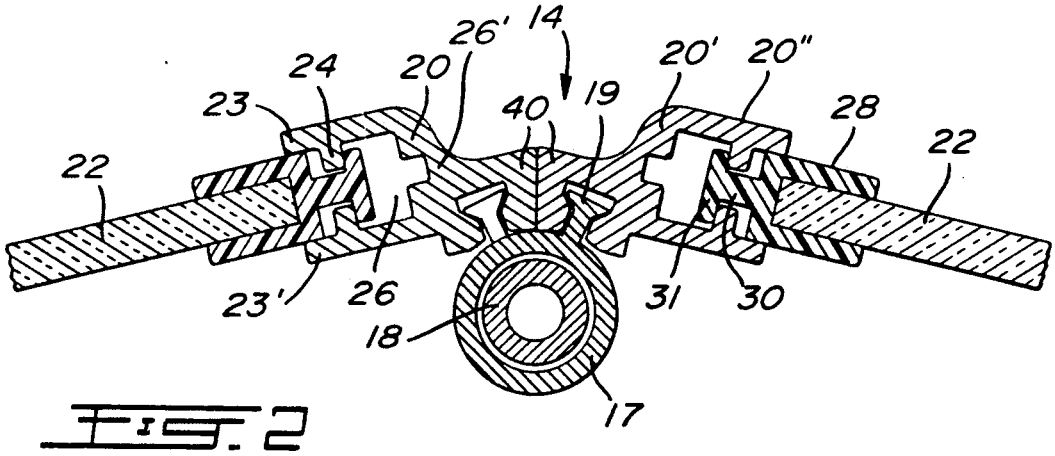
FIG. 2 is a fragmented section view illustrating the construction of the hinge assembly of the present invention.

Referring now additionally to FIG. 2, there is shown the construction of the hinge assembly 14 of the present invention. As herein shown, the hinge assembly is comprised of a plurality of hinge attaching members 17 which are constituted by a plurality of hollow tubes disposed about a hinge rod 18 of circular cross-section. The tubes 17 are maintained in end-to-end relationship as shown in FIG. 1 by securing a washer and fastener 18 at opposed ends of the hinge rod 18, as is well known in the art. Each of the hollow tubes 17 is provided with an integrally formed T-shaped connecting rib 19 which extends longitudinally on the outer side wall thereof. These hollow tubes 17 are also alternately connected to a respective one of two adjacent connecting posts 20, herein posts 20 and 20'. These connecting posts are usually extruded from an aluminum.

Figure 3:
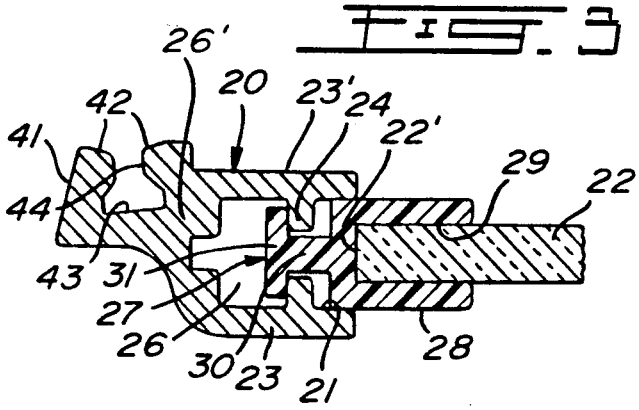
FIG. 3 is a section view illustrating the construction of the hinge connecting post of the present invention as secured to a connector strip attached to a transparent panel.

The present invention resides in the construction of the hinge connecting post 20. With reference now additionally to FIGS. 3 to 7, it can be seen that each of the connecting posts 20, see for example FIG. 3, is provided with a connecting slot 21 for securing panel elements such as the glass or clear plastic pane 22 thereto. Other panel elements such as cross members 23 (see FIG. 1) are also connected to these slots 21. The connecting slot 21 as herein shown is a rectangular slot defined between opposed parallel side walls 23 and 23' of the post and a bottom wall 26'. A retention rib 24 extends transversely from an inner face of each of the side walls 23 and 23' and is disposed in alignment with one another whereby to define an inner slotted opening 25 and an inner cavity 26. These ribs 24 are spaced inwardly of the open end of the connecting slot with the opposed side walls 23 and 23' extending forwardly of the ribs to constitute a pair of extension protective flanges.

The purpose of the protective flanges is to overlap the attachment member 27 of a plastic extrusion connector strip 28 which retains the panels 22 and interconnects them with the post 20. These connector strips 28 are provided with a U-shaped panel-receiving slot 29 which overlaps a vertical side edge of the panel member 22. The attachment member 27 is usually a T-shaped member having a rib portion 30 which extends through the inner slot opening 25 so as to locate its transverse end wall 31 captive within the cavity 26. With the prior art connecting post, a typical example of which is shown at 32 in FIG. 4, there is no protection of the rib portion 30 of the connector strip from either side of the closure. Accordingly, the rib portion 30 is slightly visible intermediate the end wall 33 of the post 32 and the rear wall 34 of the connector strip. By inserting a cutting blade in the opening indicated by arrow 35, it is possible to slit the plastic rib 30 and remove the panel 22 to permit access within the closure. With the present invention, it can be seen that the protective side wall 23 extends beyond or overlaps and conceals the attachment member 27 to prevent the removal thereof by slitting the rib post 30. In fact, the side walls 23 and 23' overlap the side walls of the U-shaped panel-receiving slot 29 and extends beyond the end wall 22' of the panel 22 so that even if the outer side wall 28 of the connector strip was severed at the end of the connecting post, it would still not be possible to remove the panel 22 as an end portion thereof still extends in between the side walls 23 of the post. In order to provide this protection, it is pointed out that an extension side wall 23 may be provided only on the outside surface 20" (see FIG. 2) of the connector post 20.

Referring now more specifically to FIGS. 2 and 5 to 7, there will be described the construction of a detachable securement means in the form of a connecting element 40 which is integrally formed with the hinge connecting post 20 and which is disposed rearwardly of the connecting slot. The connecting element 40, as more clearly seen in FIG. 7, extends all along the connecting post 20, which is also an aluminum extrusion post, and is provided with a flat outer abutment face 41 and a connecting face 42 which usually follows the curvature of the outer wall of the hollow tubes 17. An elongated slot 43 of substantially T-shaped cross section is provided in the face 42. The slot defines a restricted throat opening 44 to receive a T-shaped connecting rib therethrough whereby to secure the rib to the hinge attaching members. As herein shown, the T-shaped rib is that formed integrally with the hollow tube, namely rib 19. As can be seen, the elongated slot 43 extends at an angle which is slightly greater than the normal to the longitudinal plane 45 of the connecting slot 21.

Figure 4:
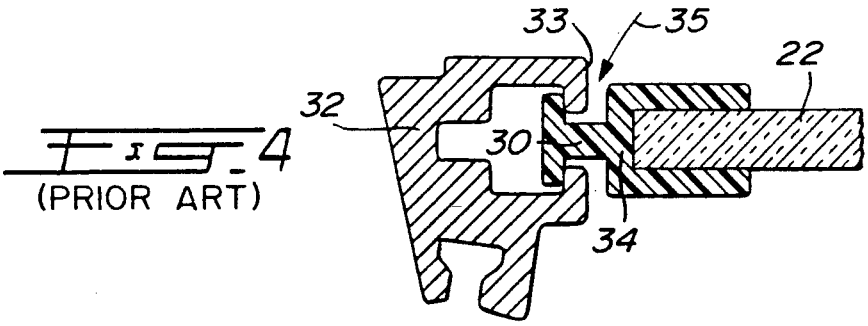
FIG. 4 (PRIOR ART)
FIG. 4 is a similar view to FIG. 3 illustrating the construction of a hinge connecting post of the prior art.

By locating the connecting element 40 rearwardly of the connecting slot 21, the hinge point 46 is moved rearwardly of the slot 21 and this provides two advantages. One advantage is that when the panels are in the extended position, the panels are disposed in an undulating manner which is closer to the flat vertical plane of the opening as illustrated at 47 with reference to hinge point 46'. With the prior art, the hinge point is further from the vertical plane 47 and is illustrated by hinge point 48. The result of this is that when constructing a closure door, there is a reduction in the number of panels necessary to span the entire opening, and this results in a material savings. Also, the position of the connecting element 40 and its configuration also results in a material savings, as compared with the hinge posts of the prior art 32 as shown in FIG. 4.

Figure 6:
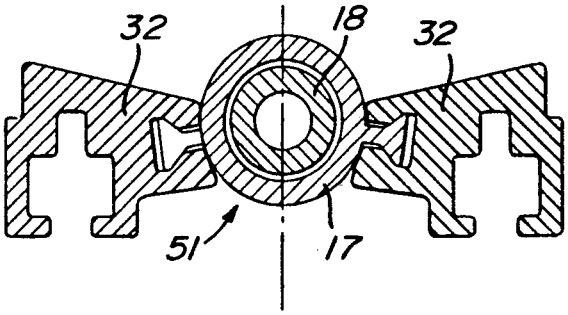
FIG. 6 (PRIOR ART)
FIG. 6 is a view similar to FIG. 5 but showing a prior art hinge assembly in the stored position.
Figure 7:
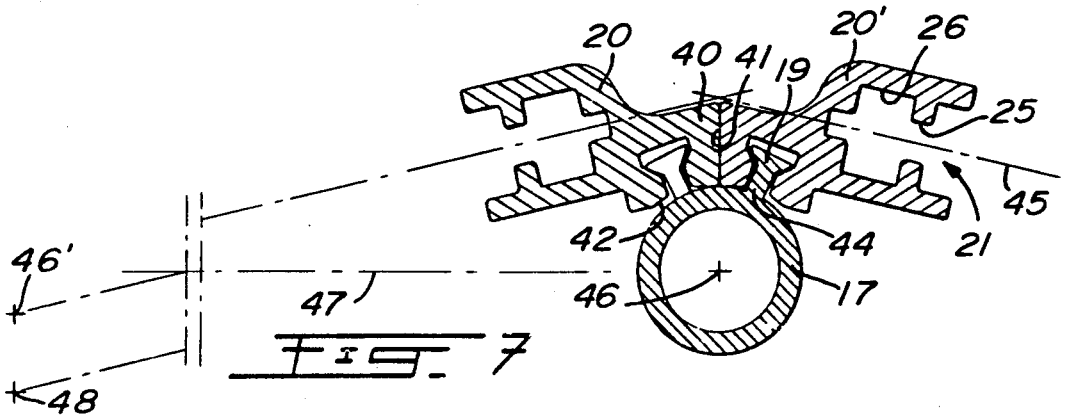
FIG. 7 is a section view showing the hinge assembly in an extended position.

Another advantage of the construction of the connector element 40 of the present invention is better illustrated in FIGS. 5 and 6. As shown in FIG. 5, when the folding closure is in a stored position, the connecting posts extend in substantially parallel planes to one another and because of their configuration, the hinge assembly is much narrower in width than with the known prior art type of connecting posts as shown in FIG. 6. This results in a space savings of between 15–20% which means that the collapsed closure takes less space in the opening when it is in a stored position. This space saving is illustrated by the area 49 between the outside wall of the connecting post and the plane 50 which represents the outside wall of the connecting post of the prior art hinge assembly 51 as shown in FIG. 6. It is also pointed out that because the hinge angle of the connector post of the present invention is closer to a horizontal plane, there is less vision distortion by the plastics or glass of the clear panels 22 and therefore a better visibility is achieved.

It is within the ambit of the present invention to cover any obvious modifications of the preferred embodiment as shown herein provided such modifications fall within the scope of the appended claims.

We claim:

1. A folding closure displaceably supportable in an opening to secure said opening, said closure being comprised of a plurality of elongated vertical panels interconnected along their vertical edges by a hinge assembly to permit said panels to fold in an accordion fashion for storage and to extend in an undulating stretched manner to obstruct said opening, said hinge assembly having hinge attaching members to pivotally secure respective pairs of opposed panel connecting posts thereto, each said connecting post having detachable securement means for connection to said hinge attaching members, said connecting posts further having a connecting slot for securing panel elements thereto, the improvement comprising said connecting slot having an extension protective flange at least on an outer side portion of said connecting post to overlap and conceal an attachment member of a connector strip removably secured in said connecting slot, said connector strip being connected along a side edge of said vertical panels, said detachable securement means being a connection member formed integral with a bottom wall of said connecting slot and extending along the entire length of said connecting post, said connection member having a flat outer abutment face spaced from said bottom wall and a substantially transverse connecting face having an elongated slot therein.

2. A folding closure as claimed in claim 1 wherein said elongated slot has a restricted throat opening to receive a T-Shaped connecting rib therethrough, said rib being secured to said hinge attaching members.

3. A folding closure as claimed in claim 2 wherein said elongated slot in said connecting face extends at an angle slightly greater than the normal to the longitudinal plane of said connecting slot.

4. A folding closure as claimed in claim 3 wherein said hinge attaching members are a plurality of hollow tubes disposed about a hinge rod of circular cross-section, each said hollow tubes having one of said T-shaped connecting ribs formed therewith and extending longitudinally on an outer side wall thereof, said hollow tubes being connected alternately to a respective one of two adjacent ones of said connecting posts.

5. A folding closure as claimed in claim 4 wherein said connecting posts are aluminum extruded posts, said hollow tubes and T-shaped connecting ribs being integrally formed from an aluminum extrusion.

6. A folding closure as claimed in claim 1 wherein said connecting slot is a rectangular slot defined between opposed parallel side walls and said bottom wall, and a retention rib extending transversely from an inner face of each said side wall and in alignment with one another to define an inner slotted opening, said ribs being spaced inwardly of an open end of said connecting slot, said opposed side walls forwardly of said ribs constituting a pair of said extension protective flanges.

7. A folding closure as claimed in claim 6 wherein said connector strip is a plastics extrusion strip having a U-shaped panel-receiving slot, said attachment member being a T-shaped rib extending rearwardly of said panel-receiving slot.

8. A folding closure as claimed in claim 7 wherein a transparent panel is secured in said panels and retained between opposed panel-receiving slots of opposed connector strips respectively secured to connecting posts of opposed hinge assemblies.

9. A folding closure as claimed in claim 8 wherein said U-shaped panel-receiving slot is defined by a pair of spaced side walls and an integral transverse rear wall, said T-shaped rib having a connecting arm extending from the center of said rear wall, said connecting arm extending through said inner slotted opening defined between said retention ribs in said connecting slot, said T-shaped rib having a transverse retention arm disposed captive in said connecting slot behind said retention ribs.

* * * * *